US010544590B2

(12) United States Patent
Jenkins

(10) Patent No.: US 10,544,590 B2
(45) Date of Patent: Jan. 28, 2020

(54) SYNTHETIC STARTER TILE FOR AN ANGLED ROOF INTERFACE

(71) Applicant: CertainTeed Corporation, Valley Forge, PA (US)

(72) Inventor: Robert L. Jenkins, Honey Brook, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/203,071

(22) Filed: Mar. 10, 2014

(65) Prior Publication Data

US 2014/0259980 A1 Sep. 18, 2014

Related U.S. Application Data

(60) Provisional application No. 61/798,081, filed on Mar. 15, 2013.

(51) Int. Cl.
*E04D 1/30* (2006.01)
*E04D 3/24* (2006.01)

(52) U.S. Cl.
CPC ..... *E04D 1/30* (2013.01); *E04D 3/24* (2013.01); *E04D 2001/304* (2013.01); *E04D 2001/305* (2013.01)

(58) Field of Classification Search
CPC ..... E04D 2001/304; E04D 2001/305; E04D 1/30; E04D 3/24
See application file for complete search history.

(56) References Cited

U.S. PATENT DOCUMENTS 3,797,179 A 3/1974 Jackson
4,218,857 A * 8/1980 Vallee ..... 52/94
4,888,932 A * 12/1989 Beare ..... E04D 1/30 52/748.1
5,295,340 A * 3/1994 Collins ..... E04D 1/30 52/276
5,377,459 A * 1/1995 Freiborg ..... E04D 1/30 156/227
5,419,941 A * 5/1995 Noone et al. ..... 428/141
5,575,876 A * 11/1996 Noone et al. ..... 156/221
5,813,176 A * 9/1998 Tzeng ..... B29C 67/246 52/198
6,808,785 B1 10/2004 Friedman et al.
7,351,462 B2 4/2008 Friedman et al.
(Continued)

FOREIGN PATENT DOCUMENTS

JP 9088246 3/1997
JP 9111957 4/1997
(Continued)

*Primary Examiner* — Andrew J Triggs
(74) *Attorney, Agent, or Firm* — Abel Schillinger, LLP; Thomas H. Osborn

(57) ABSTRACT

A synthetic starter tile for an angled roof interface can include a non-planar body defining a longitudinal axis. The body can include an overlap edge perpendicular to the longitudinal axis, an exposed edge opposite the overlap edge, an overlap portion extending from the overlap edge, and an exposed portion extending from the overlap portion to the exposed edge. The exposed edge can form at least one acute compound angle, $A_{CA}$, with respect to the longitudinal axis.

13 Claims, 9 Drawing Sheets

(56) References Cited

U.S. PATENT DOCUMENTS

| | | | | |
|---|---|---|---|---|
| 7,596,919 | B1 | 10/2009 | Vande Hey et al. | |
| D617,913 | S | 6/2010 | Shanes et al. | |
| 7,785,510 | B2 | 8/2010 | MacKinnon et al. | |
| D625,845 | S | 10/2010 | Shanes et al. | |
| 7,805,889 | B2 * | 10/2010 | Barnett | 52/12 |
| 7,921,606 | B2 | 4/2011 | Quaranta et al. | |
| 8,017,052 | B2 | 9/2011 | MacKinnon et al. | |
| 8,128,857 | B2 | 3/2012 | MacKinnon et al. | |
| 8,206,807 | B2 | 6/2012 | Friedman et al. | |
| 8,216,407 | B2 | 7/2012 | Kalkanoglu et al. | |
| 8,371,072 | B1 * | 2/2013 | Shanes | E04D 1/30 52/41 |
| 8,549,802 | B2 * | 10/2013 | Thagard, III | E04D 1/28 454/365 |
| 8,572,921 | B2 * | 11/2013 | Ward | B29C 43/003 52/518 |
| 9,200,450 | B2 * | 12/2015 | Thagard, III | E04D 1/28 |
| 2009/0100779 | A1 * | 4/2009 | Cluthe | 52/543 |
| 2010/0252956 | A1 | 10/2010 | MacKinnon et al. | |
| 2010/0275542 | A1 * | 11/2010 | Ward | B29C 43/003 52/309.1 |
| 2012/0272592 | A1 * | 11/2012 | Bellavia | 52/173.3 |
| 2014/0259980 | A1 * | 9/2014 | Jenkins | 52/90.2 |

FOREIGN PATENT DOCUMENTS

| | | | |
|---|---|---|---|
| JP | 2001065114 | A | 3/2001 |
| WO | 2011053401 | A1 | 5/2011 |

* cited by examiner

SYNTHETIC STARTER TILE FOR AN ANGLED ROOF INTERFACE

This application claims priority to and the benefit of U.S. Prov. Pat. App. No. 61/798,081, filed on Mar. 15, 2013, which is incorporated herein by reference in its entirety.

BACKGROUND

Field of the Disclosure

The present disclosure is directed generally to roofing materials and more particularly to synthetic roofing tiles.

Description of the Related Art

It is known in the shingle art that shingles that are applied to a roof are generally applied in courses, running up the slope of a roof, toward the apex or ridge of the roof. On a hip type roof, the shingles are similarly applied up the sloped surfaces toward the ridge of the roof and the singles meet at interfaces along hips and valleys.

In applying shingles to the different sloped surfaces of a roof, wherein those sloped surfaces meet at an apex and at hips, the various courses of shingles on each side of the apex are increasingly disposed up each slope, between the hips, until the apex or ridge of the roof is reached. At that point, it is desirable to provide a shingle that is a unitary structure that overlies a portion of each sloped surface of the roof along the hips and along the apex of the roof.

Synthetic ridge tiles are known in the art. These tiles can also be used along the hips of a hip type roof. However, these tiles are not suited for use as starter tiles for the hips of a hip type roof.

Accordingly, the roofing industry continues to need improvements in synthetic roofing tiles, particularly to synthetic roofing tiles that can be used as starter tiles for a hip of a hip type roof.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
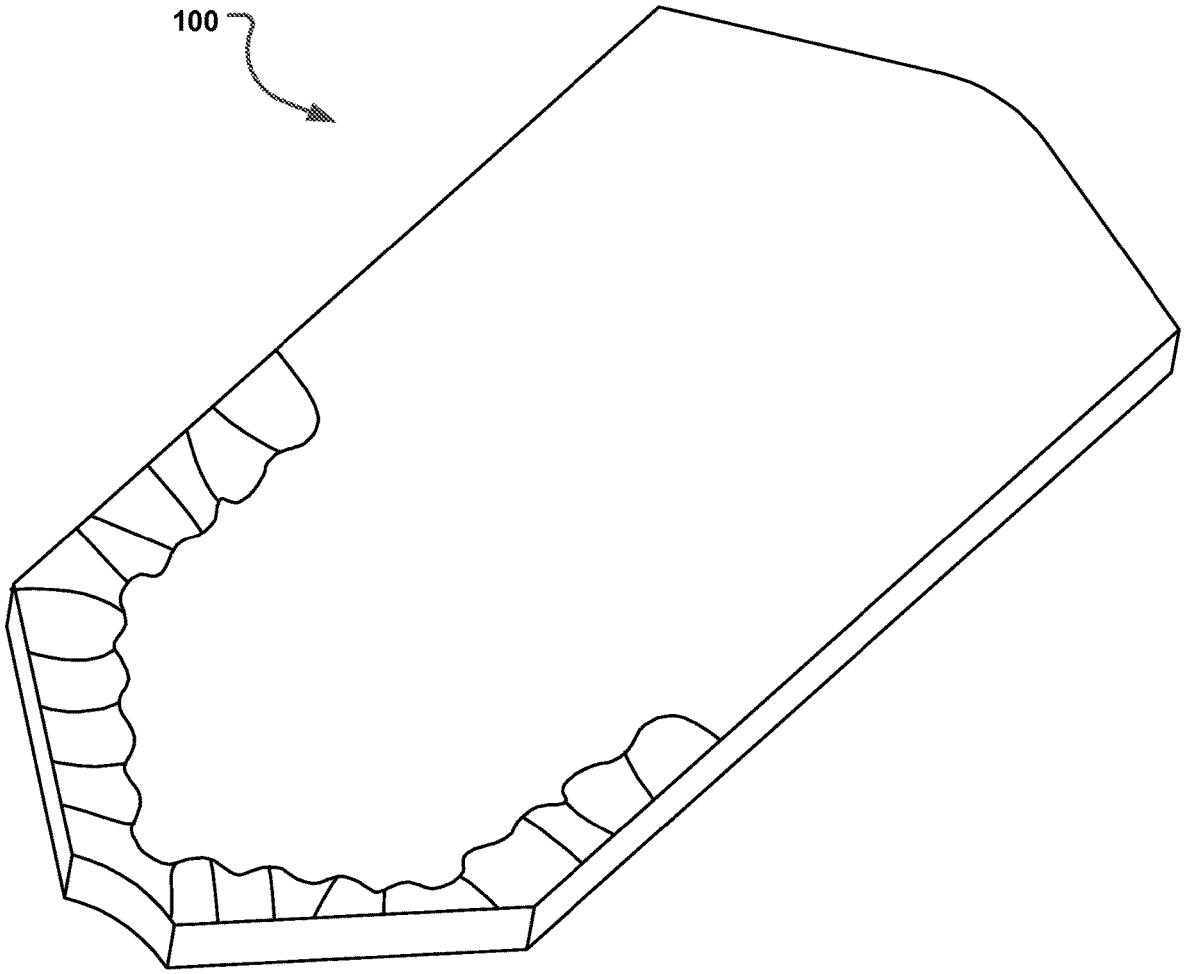
FIG. 1 includes a perspective view of a first aspect of a synthetic starter tile for an angled roof interface in accordance with an embodiment.

The following description is directed to synthetic roofing tiles, and particularly, to synthetic starter tiles configured to fit over angled roof interfaces, e.g., hip interfaces, valley interfaces, and ridge interfaces. The synthetic starter tiles can include exposed edges that are configured to approximate the shape of the outer perimeter of a roof on which the synthetic starter tiles are installed and the appearance of a natural stone tile that has been chipped during a shaping process. A typical synthetic ridge tile can be used as a starter tile for a hip, but a portion of the exposed edge will overhang the perimeter of the roof along the edge of the roof and can be unsightly or even cause rainwater to flow off of the roof in an odd manner and not enter a gutter installed at the edge of the roof. A synthetic ridge tile may be cut onsite by an installer to approximate the perimeter of the edge of the roof. However, such a cut tile may have an unsightly jagged edge in which the underside ribs of the tile are exposed. Further, such a cut tile may allow rainwater to blow, or wick, under the tile which can lead to damage to the underlying roof substrate.

Referring initially to FIG. 1 through FIG. 7, a first embodiment of a synthetic starter tile for an angled roof interface is illustrated and is generally designated 100. The synthetic starter tile 100 can include a generally non-planar body 102 having an overlap portion 104 and an exposed portion 106. The overlap portion 104 can include an overlap edge 108 and the exposed portion 106 can include an exposed edge 110.

In a particular aspect, the overlap portion 104 can include a length, $L_{OP}$, and the exposed portion 106 can also include a length, $L_{EP}$, and $L_{OP}$ can be $\geq L_{EP}$. In particular, $L_{OP}$ can be $\geq 1.25\ L_{EP}$, such as $L_{OP} \geq 1.5\ L_{EP}$, $L_{OP} \geq 1.75\ L_{EP}$, $L_{OP} \geq 2.0\ L_{EP}$, or $L_{OP} \geq 2.25\ L_{EP}$. Further, $L_{OP}$ can be $\leq 3.0\ L_{EP}$, such as $L_{OP} \leq 2.75\ L_{EP}$, or $L_{OP} \leq 2.5\ L_{EP}$. In another aspect, $L_{OP}$ can be within a range between and including any of the maximum and minimum values of $L_{OP}$ described herein.

A first lateral edge 112 can extend along the body 102 from the overlap edge 108 to the exposed edge 110. A second lateral edge 114 can also extend along the body 102 from the overlap edge 108 to the exposed edge 110 substantially parallel to the first lateral edge 112. In a particular aspect, the body 102 can define a central longitudinal axis 116 and the overlap edge 108 can be substantially perpendicular to the central longitudinal axis 116. Further, the lateral edges 112, 114 can be substantially parallel to the central longitudinal axis 116.

Figure 2:
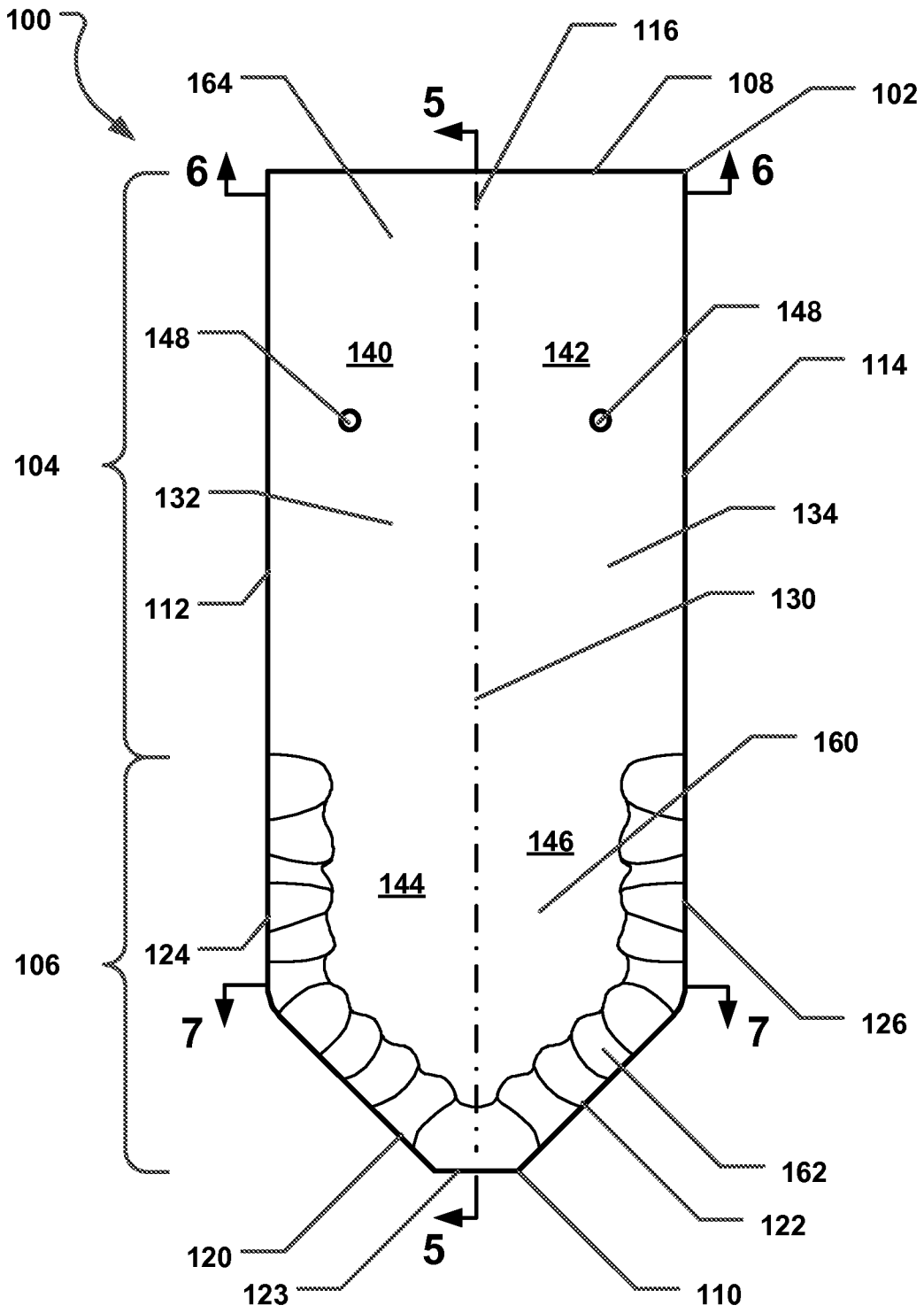
FIG. 2 includes a top plan view of a first aspect of a synthetic starter tile for an angled roof interface in accordance with an embodiment.

As indicated in FIG. 2, the exposed edge 110 can include a first angled portion 120, a second angled portion 122 opposite the first angled portion 120, and a straight portion 123 between the first and second angled portions 120, 122 that can be substantially perpendicular to the longitudinal axis 116. The exposed edge 110 can also include a first lateral exposed portion 124 and a second lateral exposed portion 126 that can extend from the first and second angled portions 120, 122 to the first and second lateral edges 112, 114, respectively. The angled portions 120, 122 of the exposed edge 110 can be angled with respect to the central longitudinal axis 116 and the lateral exposed portions 124, 126.

In a particular aspect, the first angled portion 120 can establish a first compound acute angle, $A_{CA1}$, with respect to the longitudinal axis. The second angled portion 122 can also establish a second compound acute angle, $A_{CA2}$, with respect to the longitudinal axis. Each acute compound angle includes an angle less than 90° that is angled with respect to a vertical plane passing through the longitudinal axis 116 and a horizontal plane passing through the longitudinal axis 116.

In another particular aspect, $A_{CA1}$ can be ≥25°, such as ≥30°, ≥35°, ≥40°, or ≥45°. Further, $A_{CA1}$ can be ≤65°, such as ≤60°, ≤55°, or ≤50°. $A_{CA1}$ can also be within a range between and including any of the maximum and minimum values of $A_{CA1}$ described herein. Similarly, $A_{CA2}$ can be ≥25°, such as ≥30°, ≥35°, ≥40°, or ≥45°. $A_{CA2}$ can be ≤65°, such as ≤60°, ≤55°, or ≤50°. Further, $A_{CA2}$ can be within a range between and including any of the maximum and minimum values of $A_{CA2}$ described herein. In another aspect, $A_{CA1}$ can be $=A_{CA2}\pm1.0°$, such as ±0.75°, ±0.5°, ±0.25°, or ±0.125°.

Figure 6:
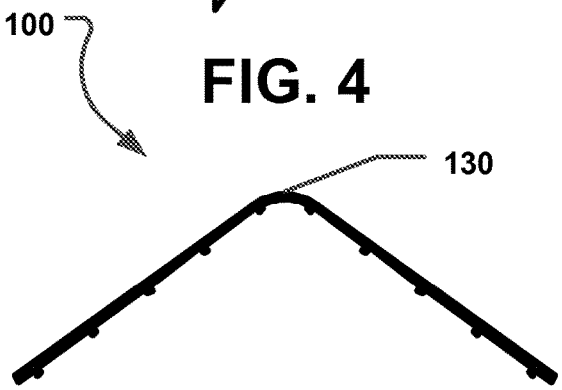
FIG. 6 includes a cross-sectional view of a first aspect of a synthetic starter tile for an angled roof interface in accordance with an embodiment taken along line 6-6 in FIG. 2.
Figure 7:
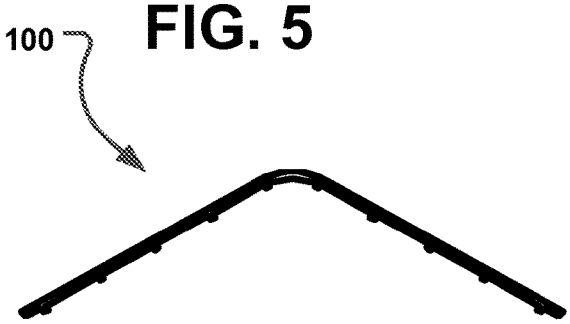
FIG. 7 includes a cross-sectional view of a first aspect of a synthetic starter tile for an angled roof interface in accordance with an embodiment taken along line 7-7 in FIG. 2.

FIG. 1 through FIG. 7 further indicate that the synthetic starter tile 100 can include a ridge 130 extending between overlap edge 108 and the exposed edge 110 along the central longitudinal axis 116. In cross-section, as indicated in FIG. 6 and FIG. 7, the synthetic starter tile 100 can be generally V-shaped. In another aspect, the synthetic starter tile 100 can be generally bowed.

The synthetic starter tile 100 can further include a first side 132 extending from the ridge 130 to the first lateral edge 112 between the overlap edge 108 and the exposed edge 110. Moreover, a second side 134 can extend from the ridge 130 to the second lateral edge 114 between the overlap edge 108 and the exposed edge 100. Each side 132, 134 can an overlap portion 140, 142 and an exposed portion 144, 146. Further, the overlap portion 140, 142 of each side 132, 134 can include at least one anchor point 148 through which a fastener can be installed. As illustrated, the anchor points 148 may be located within the overlap portion 140, 142 of each side 132, 134 nearer to the overlap edge 108. In another aspect, described below, the anchor points 148 may be located within the overlap portion 140, 142 of each side 132, 134 nearer to the exposed portion In the case of a generally V-shaped synthetic starter tile 100, illustrated in FIG. 6 and FIG. 7, the first and second sides 132, 134 can be generally planar. Further, in the case of a generally bowed synthetic starter tile 100, the first and second sides 132, 134 can be generally curved. Further, in the case of a generally V-shaped synthetic starter tile 100, the first side 132 and the second side 134 can be angled with respect to each other to form a body angle, $A_B$. $A_B$ can vary along a length of the body from the overlap edge 108 to the exposed edge. In particular, the body 102 can include a body angle measured at the overlap edge, $A_{BOE}$, and a body angle measured at the exposed edge, $A_{BEE}$, and $A_{BEE}$ can be $>A_{BOE}\geq A_{BEE}\geq1.05\ A_{BOE}$, such as ≥1.1 $A_{BOE}$, ≥1.15 $A_{BOE}$, 1.2 $A_{BOE}$, or ≥1.25 $A_{BOE}$. In another aspect, $A_{BEE}$ can be ≤2.0 $A_{BOE}$, such as ≥1.75 $A_{BOE}$, or ≥1.5 $A_{BOE}$.

Figure 3:
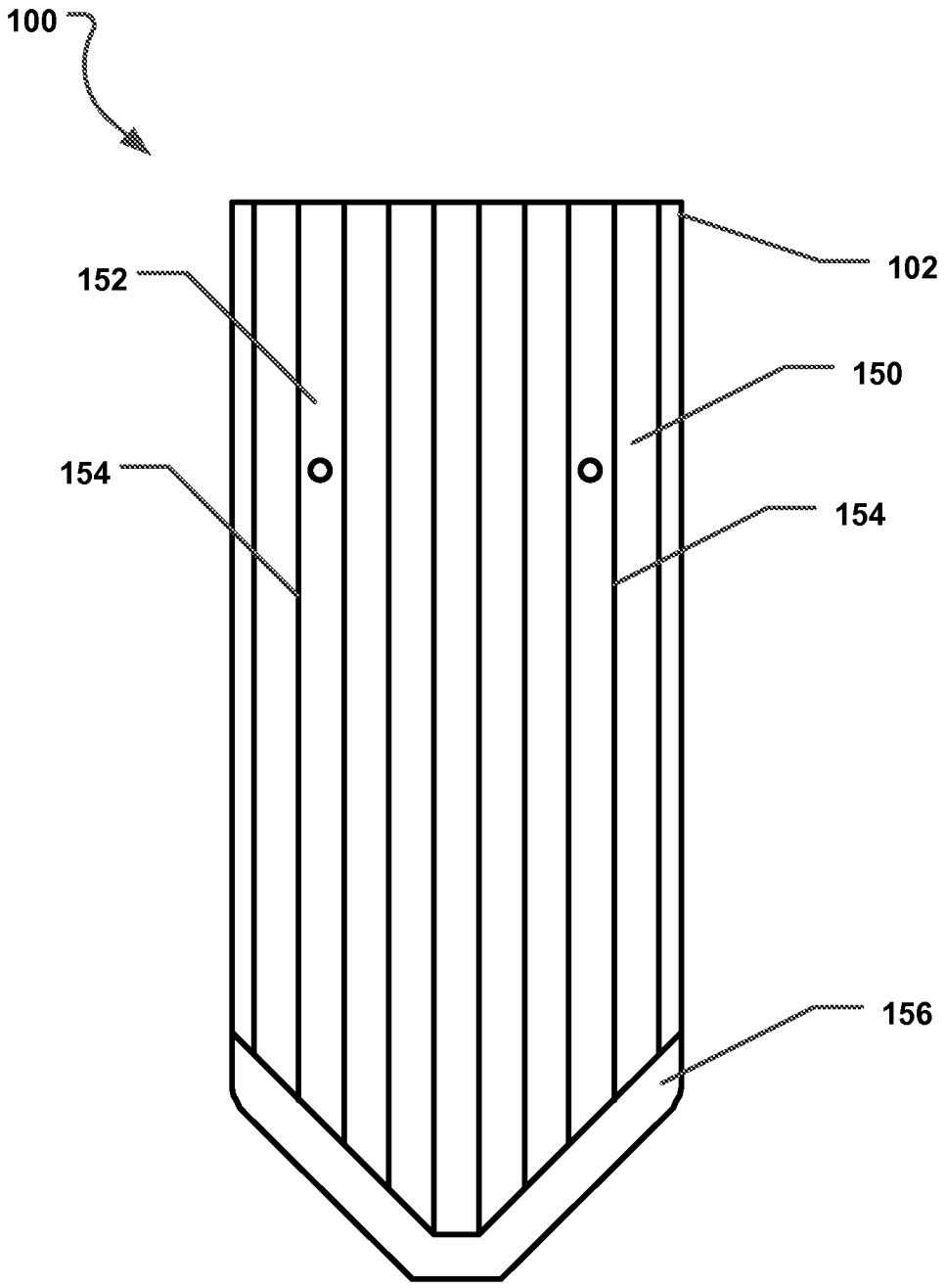
FIG. 3 includes a bottom plan view of a first aspect of a synthetic starter tile for an angled roof interface in accordance with an embodiment.
Figure 4:
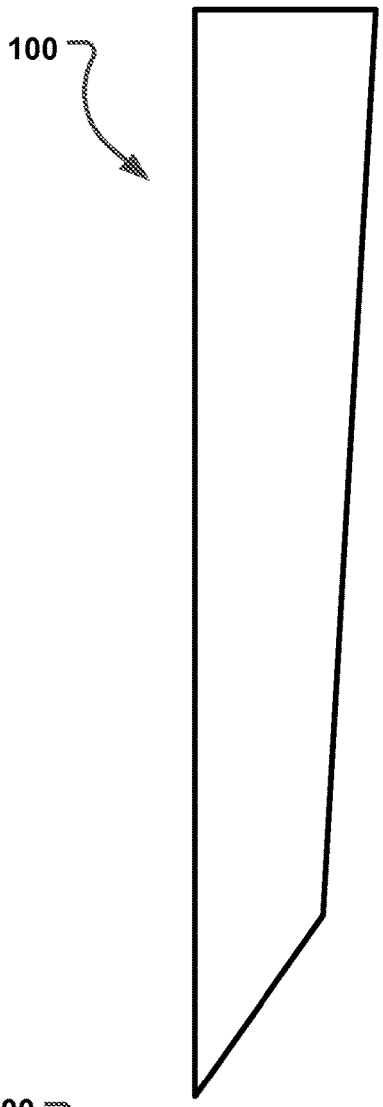
FIG. 4 includes a side plan view of a first aspect of a synthetic starter tile for an angled roof interface in accordance with an embodiment.
Figure 5:
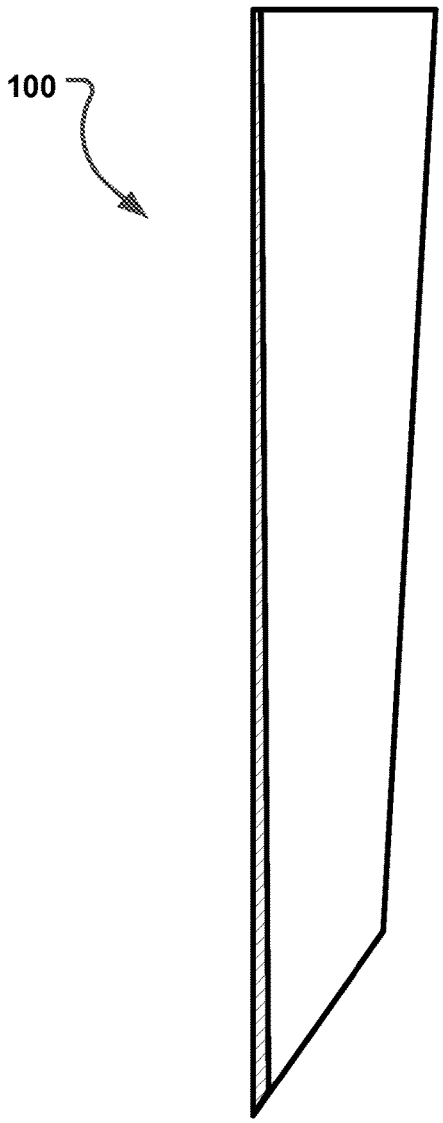
FIG. 5 includes a cross-sectional view of a first aspect of a synthetic starter tile for an angled roof interface in accordance with an embodiment taken along line 5-5 in FIG. 2.

As indicated in FIG. 3, each side 132, 134 can include a lower surface 150, 152 and at least one rib 154 can extend from the lower surfaces 150, 152 in a generally downward direction at least partially along the length of each side 132, 134 parallel to the longitudinal axis 116. While FIG. 3 illustrates ten ribs 154 extending from the body 102, the body 102 can have fewer than ten or more than ten ribs. In another aspect, described below, the body 102 may be formed without ribs.

In a particular aspect, each rib 154 can be tapered, e.g., so each rib 154 is generally wedge shaped and has a height measured from the lower surface 150, 152 that varies along the length of the rib 154. The height of each rib 154 can be greater at a location near the overlap edge 108 than a location near the exposed edge 110. Conversely, the height of each rib 154 can be greater at a location near the exposed edge 110 than a location near the overlap edge 108.

As indicated in FIG. 3, the ribs 154 can terminate near the exposed edge 110 of the body 102 at a solid perimeter edge portion 156 extending at least partially along the exposed edge 110.

In another aspect, the body 102 of the synthetic starter tile 100 can include a thickness, t, and t can vary along a length of the synthetic roofing tile. In particular, the thickness can increase from an overlap edge to an exposed edge. Conversely, the thickness can increase from the exposed edge to the overlap edge.

In a particular aspect, the body 102 can include an overlap edge thickness, $t_{OE}$, measured at the overlap edge along the central longitudinal axis and an exposed edge thickness, $t_{EE}$, measured at the exposed edge along the central longitudinal axis and $t_{OE}$ can be $<t_{EE}$. Specifically, $t_{OE}$ can be ≤0.875 $t_{EE}$, such as ≤0.75 $t_{EE}$, ≤0.625 $t_{EE}$, or ≤0.5 $t_{EE}$. Moreover, $t_{EE}$ can be ≥0.125 $t_{EE}$, such as ≥0.25 $t_{EE}$, or ≥0.5 $t_{EE}$. In another aspect, $t_{OE}$ can be within a range between and including any of the maximum and minimum values of $t_{OE}$ described herein.

In another aspect, the thickness, t, of the body 102 can vary along a width of the body 102. In particular, t can increase from the ridge to the first lateral edge and from ridge to the second lateral edge. On the other hand, t can decrease from the ridge to the first lateral edge and from ridge to the second lateral edge.

In a particular aspect, the body 102 can include a lateral edge thickness, $t_{LE}$, measured at the first lateral edge, the second lateral edge, or both lateral edges, and a ridge thickness, $t_R$, measured through the ridge along the axis 116 and $t_R$ can be $<t_{LE}$. Specifically, $t_R$ can be ≤0.875 $t_{LE}$, such as ≤0.75 $t_{LE}$, ≤0.625 $t_{LE}$, or ≤0.5 $t_{LE}$. Moreover, $t_R$ can be ≥0.125 $t_{LE}$, such as ≥0.25 $t_{LE}$, or ≥0.5 $t_{LE}$. In another aspect, $t_R$ can be within a range between and including any of the values of $t_R$ disclosed herein. $t_{LE}$ is measured near each lateral edge along a line that is perpendicular to the axis 116 along which $t_R$ is measured.

In a particular aspect, a relatively thinner ridge can allow the synthetic starter tile 100 to be easily flexed along the longitudinal axis 116 during installation to conform and match hip interfaces along roof sections having various pitches. In another aspect, the thickness of the body 102 can be uniform along the length of the body 102, the width of the body 102, or along the length and width of the body 102.

As best indicated in FIG. 2, the exposed portion 106 can includes a first surface finish 160 and a second surface finish 162. The second surface finish 162 can include a texture that is different from a texture of the first surface finish 160. In a particular aspect, the second surface finish 162 can be textured to approximate the appearance of a chipped edge of a natural slate tile. As illustrated in FIG. 2, the second surface finish 162 can extend along the exposed edge 110. Further, the first surface finish 160 can be bound by the second surface finish 162 and the overlap portion 104 of the body 102. In another aspect, the overlap portion 104 can include a third surface finish 164 that can have a texture different from the first surface finish 160 and the second surface finish 162. As described in greater detail below, the first surface finish 160 and the second surface finish 162 can be the same. As such, the exposed portion 106 can have a uniform surface finish formed with or without texture In another particular aspect, the second surface finish 162 can have a surface roughness, $R_2$, and the first surface finish 160 can have a roughness, $R_1$, and $R_2>R_1$. Further, $R_2$ can be $\geq 2\times R_1$, such as $\geq 3\times R_1$, $\geq 4\times R_1$, $\geq 5\times R_1$, or $\geq 10\times R_1$. In another aspect, $R_2$ can be $\leq 100\times R_1$, such as $\leq 75\times R_1$, $\leq 50\times R_1$, or $\leq 25\times R_1$. In still another aspect, $R_2$ can be within a range between and including any of the maximum and minimum values of $R_2$ described herein.

In still another aspect, the exposed portion 106 of the body 102 can include an area, $A_{EP}$, and the second surface finish 162 can cover an area, $A_{SSF}$. In particular, $A_{SSF}$ can be $\geq 10\%$ $A_{EP}$, such as $\geq 12.5\%$ $A_{EP}$, $\geq 15\%$ $A_{EP}$, $\geq 17.5\%$ $A_{EP}$, or $\geq 20\%$ $A_{EP}$. Moreover, wherein $A_{SSF}$ can be $\leq 40\%$ $A_{EP}$, such as $\leq 35\%$ $A_{EP}$, $\leq 30\%$ $A_{EP}$, or $\leq 25\%$ $A_{EP}$. Further still, $A_{SSF}$ can be within a range between and including any of the maximum and minimum values of $A_{SSF}$ described herein.

Referring now to FIG. 8 through FIG. 11, another aspect of a synthetic starter tile is shown and is generally designated 800. The synthetic starter tile 800 can include a body 802 having an overlap portion 804 and a recessed exposed portion 806. The overlap portion 804 can include an overlap edge 808 and the exposed portion 806 can include an exposed edge 810.

A first lateral edge 812 can extend along the body 802 from the overlap edge 808 to the exposed edge 810. A second lateral edge 814 can also extend along the body 802 from the overlap edge 808 to the exposed edge 810 substantially parallel to the first lateral edge 812. In a particular aspect, the body 802 can define a central longitudinal axis 816 and the overlap edge 808 can be substantially perpendicular to the central longitudinal axis 816. Further, the lateral edges 812, 814 can be substantially parallel to the central longitudinal axis 816.

As indicated, the exposed edge 810 can include a first angled portion 820 and a second angled portion 822 opposite the first angled portion 120. The angled portions 820, 822 can meet at a vertex 823 to form a relatively sharp point. The exposed edge 810 can also include a first lateral exposed portion 824 and a second lateral exposed portion 826 that can extend from the first and second angled portions 820, 822 to the first and second lateral edges 812, 814, respectively. The angled portions 820, 822 of the exposed edge 810 can be angled with respect to the central longitudinal axis 816 and the lateral exposed portions 824, 826.

Figure 8:
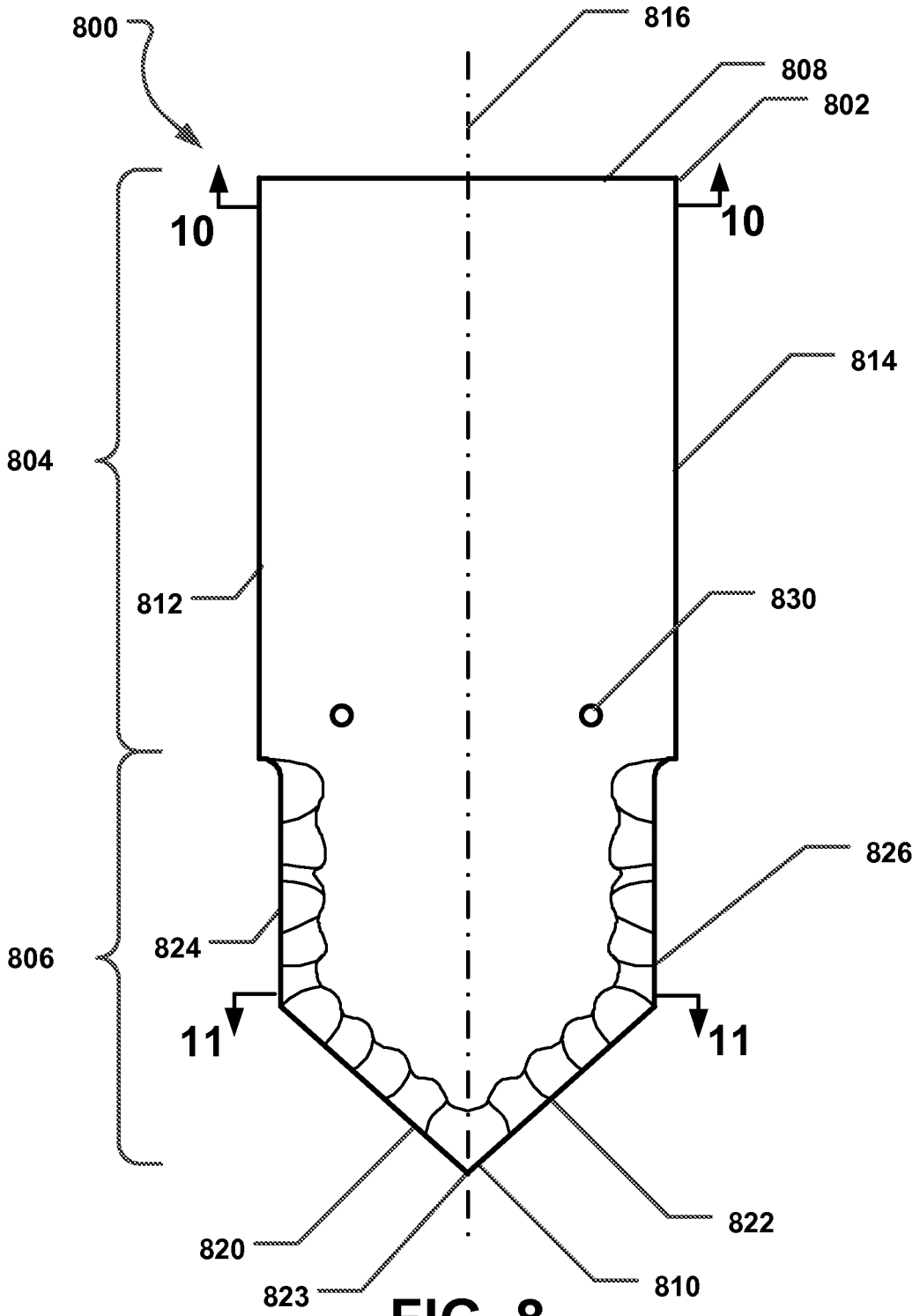
FIG. 8 includes a top plan view of a second aspect of a synthetic starter tile for an angled roof interface in accordance with an embodiment.

FIG. 8 also indicates that the body 802 of the synthetic starter tile 800 can include at least one anchor point 830 and the anchor point 830 can be located within the overlap portion 804 near the exposed portion 806. Accordingly, in certain aspects that utilize another tile, or a portion of another tile, beneath the synthetic starter tile 800, a fastener can be installed through the synthetic starter tile 800 and the other tile placed underneath the synthetic starter tile 800.

Figure 9:
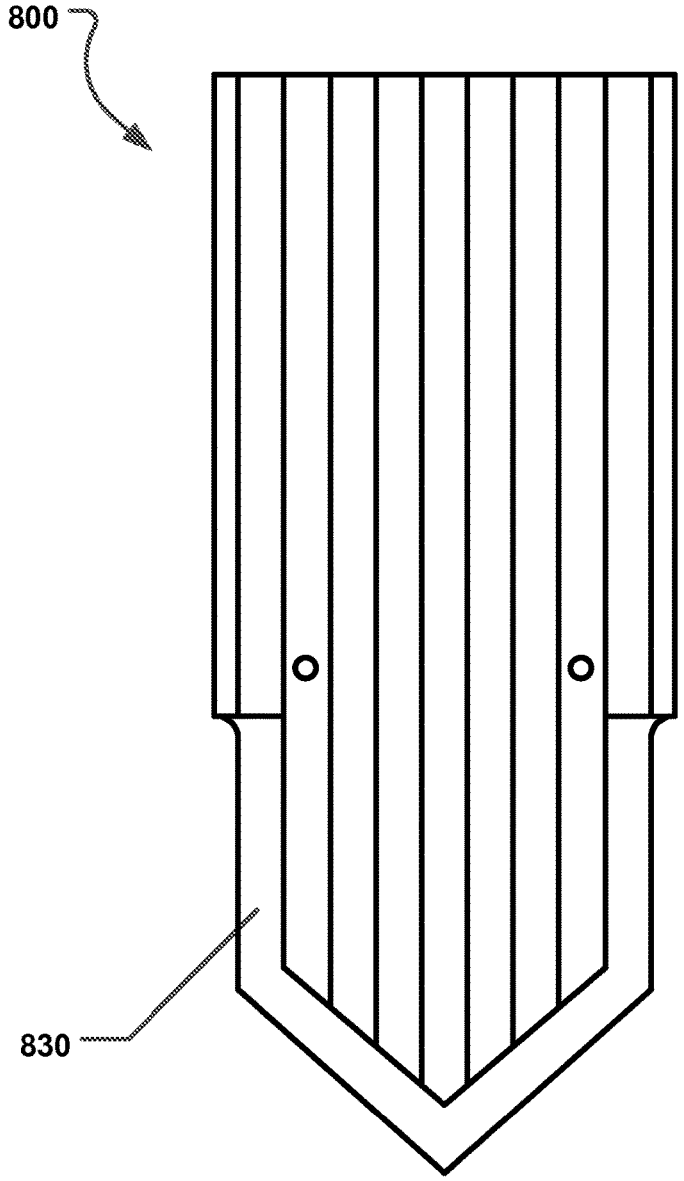
FIG. 9 includes a bottom plan view of a second aspect of a synthetic starter tile for an angled roof interface in accordance with an embodiment.
Figure 10:
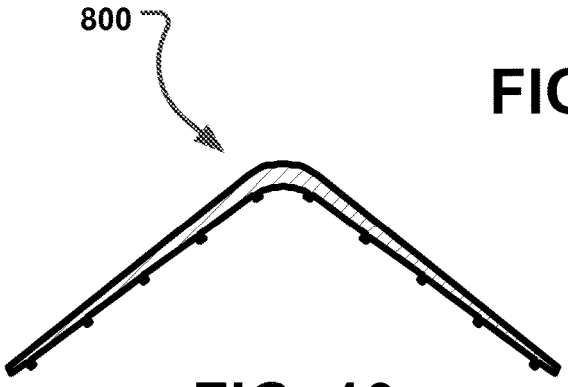
FIG. 10 includes a cross-sectional view of a second aspect of a synthetic starter tile for an angled roof interface in accordance with an embodiment taken along line 10-10 in FIG. 8.
Figure 11:
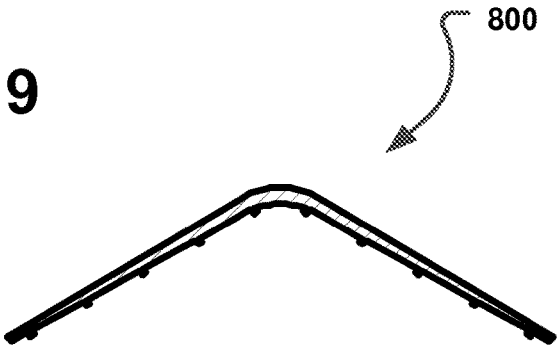
FIG. 11 includes a cross-sectional view of a second aspect of a synthetic starter tile for an angled roof interface in accordance with an embodiment taken along line 11-11 in FIG. 8.

FIG. 9 shows that the underneath of the body 802 can include a solid perimeter edge portion 830 extending along the entirety of the exposed edge 810. FIG. 10 and FIG. 11 indicate that the body 802 can be thicker through the ridge than at the lateral edges 812, 814.

Figure 12:
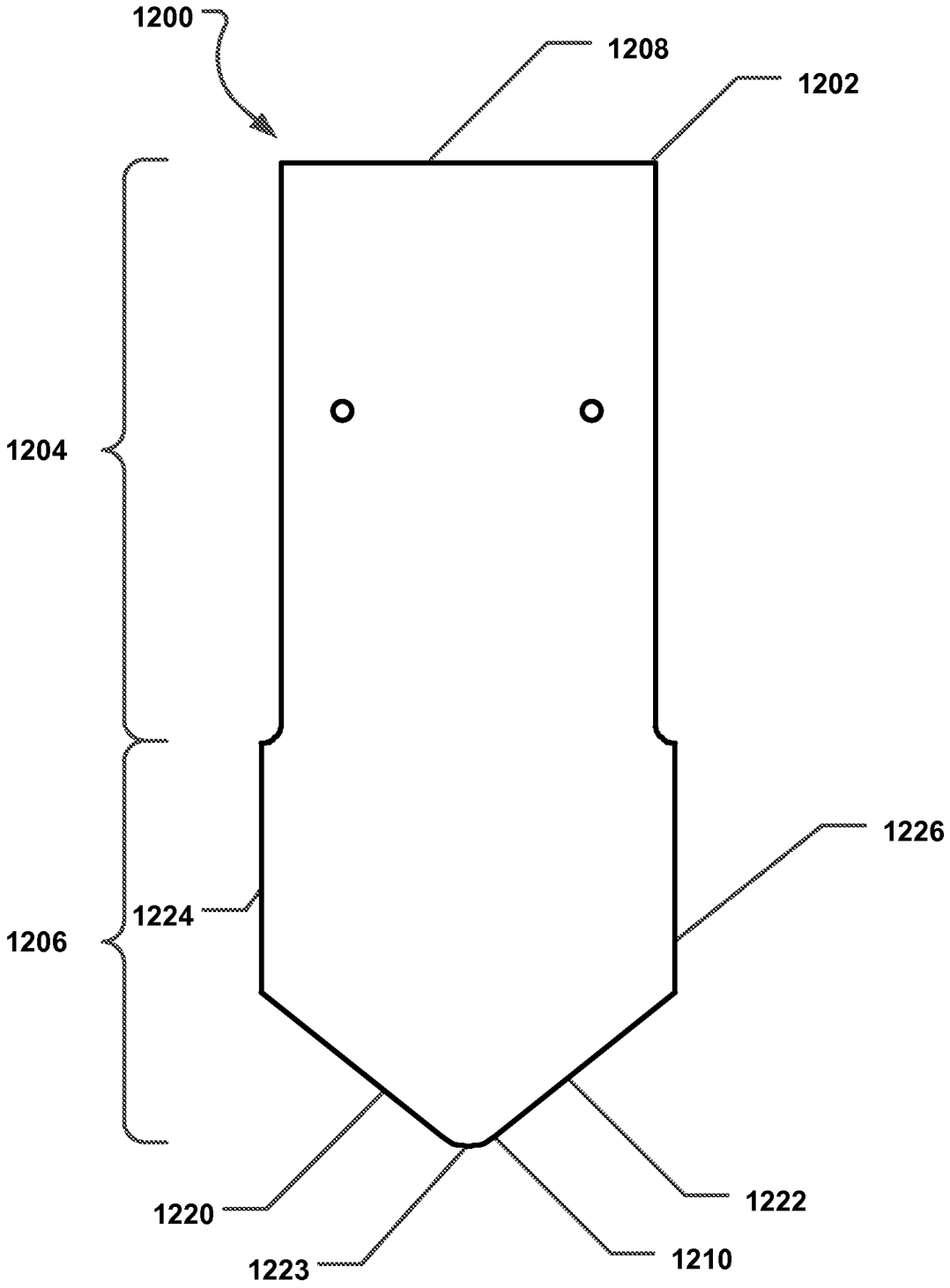
FIG. 12 includes a top plan view of a third aspect of a synthetic starter tile for an angled roof interface in accordance with an embodiment.
Figure 13:
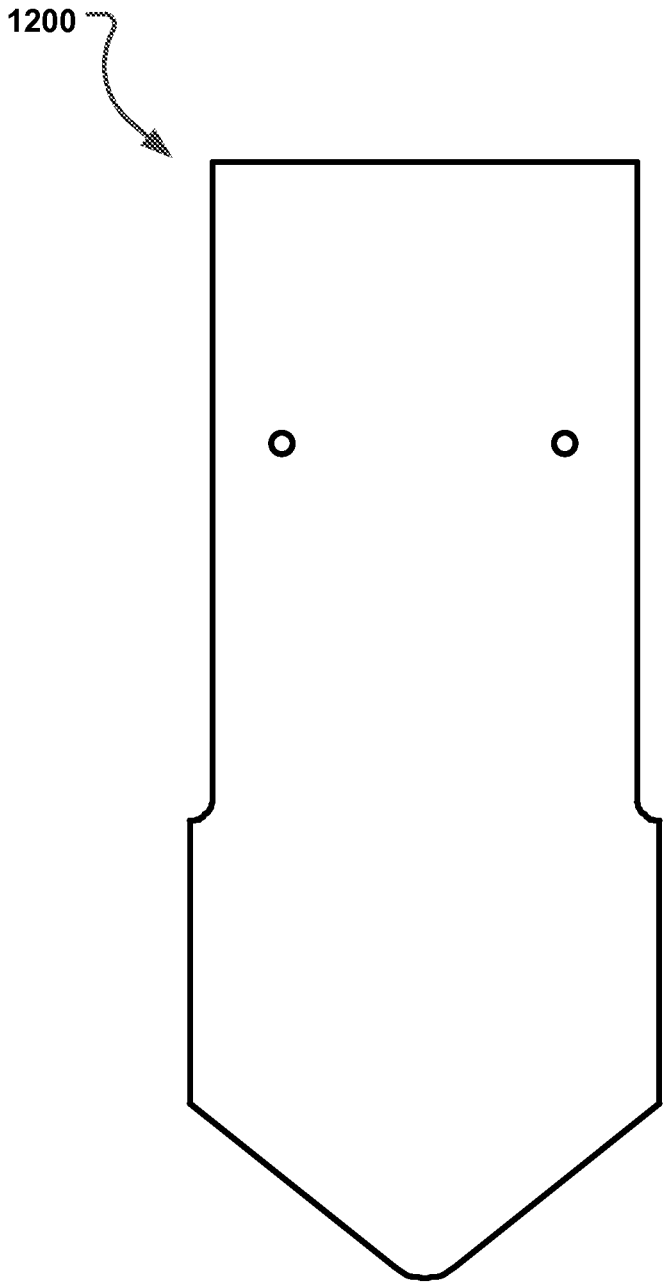
FIG. 13 includes a bottom plan view of a third aspect of a synthetic starter tile for an angled roof interface in accordance with an embodiment.

Referring to FIG. 12 and FIG. 13, still another aspect of a synthetic starter tile is shown and is generally designated 1200. The synthetic starter tile 1200 can include a body 1202 having a recessed overlap portion 1204 and an exposed portion 1206. The overlap portion 1204 can include an overlap edge 1208 and the exposed portion 1206 can include an exposed edge 1210.

As illustrated, the exposed edge 1210 can include a first angled portion 1220 and a second angled portion 1222 opposite the first angled portion 120. The angled portions 1220, 1222 can meet at a rounded portion 1223 to form a blunted, rounded point. The exposed edge 1210 can also include a first lateral exposed portion 1224 and a second lateral exposed portion 1226 that can extend from the first and second angled portions 1220, 1222 to the first and second lateral edges 1212, 1214, respectively. The angled portions 1220, 1222 of the exposed edge 1210 can be angled with respect to the central longitudinal axis 1216 and the lateral exposed portions 1224, 1226.

As illustrated in FIG. 12, the exposed portion 1206 of the body 1202 can have a uniform surface finish along the exposed portion 1206 formed without any texturing, described above. As such, the exposed edge 1210 can be rounded, or radiused. Further, the exposed edge 1210 can be tapered. Accordingly, the synthetic starter tile 1200 can be used under another synthetic starter tile formed with the textured surface finish and a relatively tight interface can be formed between the upper surface of the synthetic starter tile 1200 and the bottom surface, or a portion thereof, of the other tile placed thereon.

FIG. 13 indicates that the synthetic starter tile 1200 can be formed without ribs or other structure on the bottom surface of the body 1202. As such, the bottom surface of the synthetic starter tile 1200 can be relatively smooth.

Figure 14:
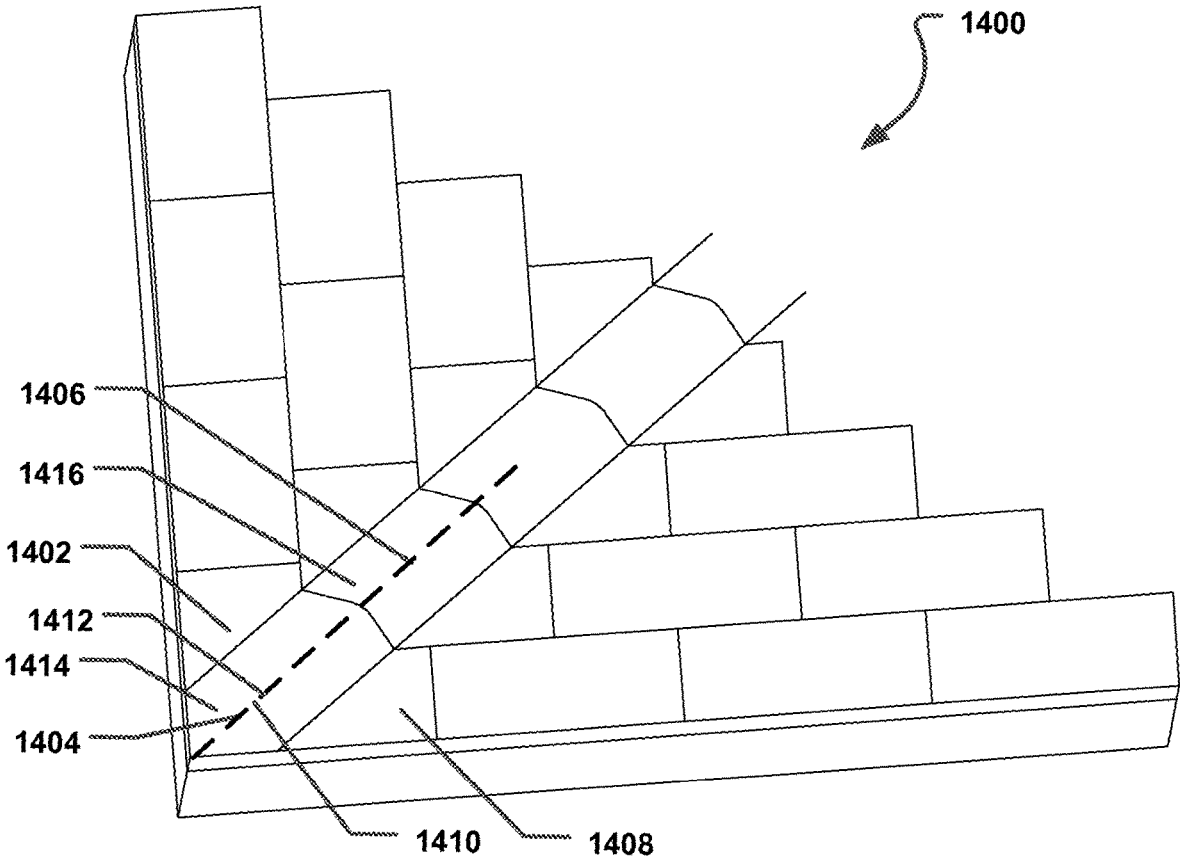
FIG. 14 includes a perspective view of a roofing system in accordance with an embodiment.

FIG. 14 illustrates a roof assembly 1400 that includes a generally planar first synthetic roofing tile 1402 having a first edge 1404 extending along an angled roof interface 1406. The roof assembly 1400 also includes a generally planar second synthetic roofing tile 1408 having a second edge 1410 that can extend along the angled roof interface 1406 adjacent to the first edge 1404 of the first synthetic roofing tile 1402 to form a synthetic roofing tile interface 1412 having a length, $L_I$.

As illustrated in FIG. 14, the roof assembly 1400 can further include a synthetic starter tile 1414 overlying the synthetic roofing tile interface by an interface overlap length, $L_{IO}$, and $L_{IO}\geq 80\%$ $L_I$. The synthetic starter tile 1414 can include of the synthetic starter tiles described herein or can include a synthetic starter tile that includes a combination of features described in conjunction with any of the synthetic starter tiles described herein. The roof assembly 1400 can also include a synthetic cover tile 1416, e.g., a ridge tile, having a non-planar body overlying at least a portion of the overlap portion of the starter tile 1414.

In another aspect, a method of installing a synthetic roof tile assembly is disclosed. The method can include installing a first generally planar synthetic roofing tile along an angled roof interface and installing a second generally planar synthetic roofing tile along the angled roof interface adjacent to the first synthetic roofing tile to form a synthetic roofing tile interface having a length, $L_I$. The method can also include installing a synthetic starter tile over the synthetic roofing tile interface by an interface overlap length, $L_{IO}$, and $L_{IO}$ can be ≥80% $L_I$.

The synthetic starter tile can include of the synthetic starter tiles described herein or can include a synthetic starter tile that includes a combination of features described in conjunction with any of the synthetic starter tiles described herein.

The method can further include installing at least one synthetic cover tile having a non-planar body over a portion of the overlap portion of the starter tile. Further, the method can include cutting the first or second generally planar synthetic roofing tile prior to installing the first or second generally planar synthetic roofing tile along the angle roof interface. Moreover, installing can include affixing with a nail, a screw, a staple, an adhesive, a chemical weld, a wire, a wire loop, a separate bracket, an attached bracket, a slate hook, or a combination thereof.

Each of the synthetic starter tile disclosed herein can include a body formed from a polymeric material. The body can also include a co-extruded polymeric material. Further, the body can include a core material and a skin material at least partially overlying the core material. For example, the skin material may overly only the exposed portion. In another aspect, the core material can include a filled polymeric material. Moreover, the filled polymeric material can include a thermoplastic polymeric material and a filler.

The thermoplastic polymeric material can be selected from a group including polyvinylchloride (PVC), polyethylene (PE), polypropylene (PP), polybutene (PB-1) polymethylpentene (PMP), polyacrylates (PAC), polyethyleneterephthalate (PET), polybutyleneterephthalate (PBT), polyethylenenaphthalate (PEN), ethylene-propylene-diene monomer copolymers (EPDM), a copolymer thereof, a binary blend thereof, and a ternary blend thereof.

Additionally, the filler can include a mineral filler, an organic filler, a nanofiller, a powdered filter, an ultra-fine powdered filler, a reinforcing filler, a fiber filler, a recycled polymer filler, or any combination thereof. In particular, the filled polymeric material can include an amount of filler that can be ≥5% wt, such as ≥10%, ≥15%, ≥20%, ≥25%, ≥30%, ≥35%, or ≥40%. The amount of filler can be ≤90% wt, such as ≤85%, ≤80%, ≤75%, or ≤70%.

The skin material can include a thermoplastic polymeric material. The thermoplastic polymeric material can include a polyolefin, a polyacrylate, or a combination thereof. Further, the polyolefin can include polyethylene (PE), polypropylene (PP), polymethylpentene (PMP), polybutene (PB-1), or a combination thereof. In another aspect, the skin material can include an additive. The additive can include a UV-light stabilizer, a thermal stabilizer, a pigment, a compatibilizer, a processing aid, a flame retardant, a foaming agent, or a combination thereof.

Without limiting the scope, the following item list describes embodiments of the present disclosure:

Item 1. A synthetic starter tile for an angled roof interface, comprising:

a non-planar body defining a longitudinal axis, the body comprising:

an overlap edge perpendicular to the longitudinal axis;

an exposed edge opposite the overlap edge;

an overlap portion extending from the overlap edge; and an exposed portion extending from the overlap portion to the exposed edge wherein the exposed edge forms at least one acute compound angle, $A_{CA}$, with respect to the longitudinal axis.

Item 2. An assembly for covering an angled roof interface, comprising:

a synthetic starter tile comprising:

a non-planar body defining a longitudinal axis, wherein the body comprises:

an overlap edge perpendicular to the longitudinal axis;

an exposed edge opposite the overlap edge;

an overlap portion extending from the overlap edge; and an exposed portion extending from the overlap portion to the exposed edge, wherein the exposed edge forms at least one acute compound angle, $A_{CA}$, with respect to the longitudinal axis; and a synthetic cover tile having a non-planar body overlying at least a portion of the overlap portion of the starter tile.

Item 3. A roof assembly, comprising:

a generally planar first synthetic roofing tile having a first edge extending along an angled roof interface;

a generally planar second synthetic roofing tile having a second edge extending along the angled roof interface adjacent to the first edge of the first synthetic roofing tile to form a synthetic roofing tile interface having a length, $L_I$;

a synthetic starter tile overlying the synthetic roofing tile interface by an interface overlap length, $L_{IO}$, and $L_{IO}$≥80% $L_I$, wherein the synthetic starter tile comprises:

a non-planar body defining a longitudinal axis, wherein the body comprises:

an overlap edge perpendicular to the longitudinal axis;

an exposed edge opposite the overlap edge;

an overlap portion extending from the overlap edge; and an exposed portion extending from the overlap portion to the exposed edge, wherein the exposed edge forms at least one acute compound angle, $A_{CA}$, with respect to the longitudinal axis; and a synthetic cover tile having a non-planar body overlying at least a portion of the overlap portion of the starter tile.

Item 4. A method of installing a synthetic roof tile assembly, the method comprising:

installing a first generally planar synthetic roofing tile along an angled roof interface;

installing a second generally planar synthetic roofing tile along the angled roof interface adjacent to the first synthetic roofing tile to form a synthetic roofing tile interface having a length, $L_I$;

installing a synthetic starter tile over the synthetic roofing tile interface by an interface overlap length, $L_{IO}$, wherein $L_{IO}$≥80% $L_I$ and wherein the synthetic starter tile includes a non-planar body defining a longitudinal axis and the body includes an overlap edge that is perpendicular to the longitudinal axis, an overlap portion extending from the overlap edge, an exposed portion extending from the overlap portion to an exposed edge, wherein the exposed edge forms at least one acute compound angle, $A_{CA}$, with respect to the longitudinal axis; and installing at least one synthetic cover tile having a non-planar body over a portion of the overlap portion of the starter tile.

Item 5. The method of item 4, further comprising:

cutting the first or second generally planar synthetic roofing tile prior to installing the first or second generally planar synthetic roofing tile along the angle roof interface.

Item 6. The method of item 4, wherein installing can include affixing with a nail, a screw, a staple, an adhesive, a chemical weld, a wire, a wire loop, a separate bracket, an attached bracket, a slate hook, or a combination thereof.

Item 7. The synthetic starter tile or assembly, according to items 1 or 2, wherein the synthetic starter tile is configured to fit over an angled roof interface.

Item 8. The synthetic starter tile or assembly, according to item 7, wherein the angle roof interface comprises a hip interface.

Item 9. The synthetic starter tile or assembly, according to item 7, wherein the angle roof interface comprises a valley interface.

Item 10. The synthetic starter tile or assembly, according to item 7, wherein the angle roof interface comprises a ridge interface.

Item 11. The synthetic starter tile, assembly, or method according to anyone of items 1, 2, 3, or 4, wherein the non-planar body comprises a generally V-shaped cross-section perpendicular to the longitudinal axis.

Item 12. The synthetic starter tile, assembly, or method according to anyone of items 1, 2, 3, or 4, wherein the non-planar body comprises a generally bow shaped cross-section perpendicular to the longitudinal axis.

Item 13. The synthetic starter tile, assembly, or method according to any one of items 1, 2, 3, or 4, wherein the exposed portion includes a first surface finish having a first texture and a second surface finish having a second texture different from the first texture.

Item 14. The synthetic starter tile, assembly, or method of item 13, wherein the second surface finish extends along the exposed edge and the first surface finish is bound by the second surface finish and the overlap portion of the body.

Item 15. The synthetic starter tile, assembly, or method of item 13, wherein the overlap portion includes a third surface finish having a third texture different from the first texture and the second texture.

Item 16. The synthetic starter tile, assembly, or method of item 14, wherein the second surface finish has a surface roughness, $R_2$, and the first surface finish has a roughness, $R_1$, and $R_2>R_1$.

Item 17. The synthetic starter tile, assembly, or method of item 16, wherein $R_2 \geq 2 \times R_1$, such as $\geq 3 \times R_1$, $\geq 4 \times R_1$, $\geq 5 \times R_1$, or $\geq 10 \times R_1$.

Item 18. The synthetic starter tile, assembly, or method of item 17, wherein $R_2 \leq 100 \times R_1$, such as $\leq 75 \times R_1$, $\leq 50 \times R_1$, or $\leq 25 \times R_1$.

Item 19. The synthetic starter tile, assembly, or method of item 13, wherein the exposed portion of the body has an area, $A_{EP}$, the second surface finish covers an area, $A_{SSF}$, and $A_{SSF} \geq 10\%\ A_{EP}$, such as $\geq 12.5\%\ A_{EP}$, $\geq 15\%\ A_{EP}$, $\geq 17.5\%\ A_{EP}$, or $\geq 20\%\ A_{EP}$.

Item 20. The synthetic starter tile, assembly, or method of item 19, wherein $A_{SSF}$ is $\leq 40\%\ A_{EP}$, such as $\leq 35\%\ A_{EP}$, $\leq 30\%\ A_{EP}$, or $\leq 25\%\ A_{EP}$.

Item 21. The synthetic starter tile, assembly, or method according to any one of items 1, 2, 3, or 4, wherein the overlap portion includes a length, $L_{OP}$, and the exposed portion includes a length, $L_{EP}$, and $L_{OP} \geq L_{EP}$.

Item 22. The synthetic starter tile, assembly, or method of item 21, wherein $L_{OP} \geq 1.25\ L_{EP}$, such as $L_{OP} \geq 1.5\ L_{EP}$, $L_{OP} \geq 1.75\ L_{EP}$, $L_{OP} \geq 2.0\ L_{EP}$, or $L_{OP} \geq 2.25\ L_{EP}$.

Item 23. The synthetic starter tile, assembly, or method of item 22, wherein $L_{OP} \leq 3.0\ L_{EP}$, such as $L_{OP} \leq 2.75\ L_{EP}$, or $L_{OP} \leq 2.5\ L_{EP}$.

Item 24. The synthetic starter tile, assembly, or method according to any one of items 1, 2, 3, or 4, wherein the body of the starter tile further comprises:

a ridge extending between the overlap edge and the exposed edge;

a first side extending from the ridge; and a second side extending from the ridge, wherein the first side and the second side are angled with respect to each other to form a body angle, $A_B$, and wherein each planar side includes an overlap portion and an exposed portion.

Item 25. The synthetic starter tile, assembly, or method of item 24, wherein the overlap portion of each planar side includes at least one anchor point through which a fastener can be installed.

Item 26. The synthetic starter tile, assembly, or method of item 24, wherein each planar side includes a lower surface and at least one rib extends from the lower surface at least partially along the length of each planar side parallel to the longitudinal axis.

Item 27. The synthetic starter tile, assembly, or method of item 26, wherein each rib is tapered.

Item 28. The synthetic starter tile, assembly, or method according to anyone of items 1, 2, 3, or 4, wherein the exposed edge comprises a first angled portion and a second angled portion opposite the first angle portion.

Item 29. The synthetic starter tile, assembly, or method of item 28, wherein the first angled portion establishes a first compound acute angle, $A_{CA2}$, with respect to the longitudinal axis.

Item 30. The synthetic starter tile, assembly, or method of item 29, wherein $A_{CA1} \geq 25°$, such as $\geq 30°$, $\geq 35°$, $\geq 40°$, or $\geq 45°$.

Item 31. The synthetic starter tile, assembly, or method of item 30, wherein $A_{CA1} \leq 65°$, such as $\leq 60°$, $\leq 55°$, or $\leq 50°$.

Item 32. The synthetic starter tile, assembly, or method of item 29, wherein the second angled portion establishes a second compound acute angle, $A_{CA2}$, with respect to the longitudinal axis.

Item 33. The synthetic starter tile, assembly, or method of item 32, wherein $A_{CA2} \geq 25°$, such as $\geq 30°$, $\geq 35°$, $\geq 40°$, or $\geq 45°$.

Item 34. The synthetic starter tile, assembly, or method of item 33, wherein $A_{CA2} \leq 65°$, such as $\leq 60°$, $\leq 55°$, or $\leq 50°$.

Item 35. The synthetic starter tile, assembly, or method of item 32, wherein $A_{CA1} = A_{CA2} \pm 1.0°$, such as $\pm 0.75°$, $\pm 0.5°$, $\pm 0.25°$, or $\pm 0.125°$.

Item 36. The synthetic starter tile, assembly, or method of item 24, wherein $A_B$ varies along a length of the body from an overlap edge to an exposed edge.

Item 37. The synthetic starter tile, assembly, or method of item 36, wherein the body comprises a body angle measured at the overlap edge, $A_{BOE}$, and a body angle measured at the exposed edge, $A_{BEE}$, and $A_{BEE} > A_{BOE}$.

Item 38. The synthetic starter tile, assembly, or method of item 37, wherein $A_{BEE} \geq 1.05\ A_{BOE}$, such as $\geq 1.1\ A_{BOE}$, $\geq 1.15\ A_{BOE}$, $1.2\ A_{BOE}$, or $\geq 1.25\ A_{BOE}$.

Item 39. The synthetic starter tile, assembly, or method of item 38, wherein $A_{BEE} \leq 2.0\ A_{BOE}$, such as $\geq 1.75\ A_{BOE}$, or $\geq 1.5\ A_{BOE}$.

Item 40. The synthetic starter tile, assembly, or method according to any one of items 1, 2, 3, or 4, wherein the body comprises a thickness, t, and t varies along a length of the synthetic starter tile.

Item 41. The synthetic starter tile, assembly, or method of item 40, wherein the thickness increases from an overlap edge to an exposed edge.

Item 42. The synthetic starter tile, assembly, or method of item 41, wherein the body comprises an overlap edge thickness, $t_{OE}$, measured at the overlap edge along the central longitudinal axis and an exposed edge thickness, $t_{EE}$, measured at the exposed edge along the central longitudinal axis and $t_{OE} < t_{EE}$.

Item 43. The synthetic starter tile, assembly, or method of item 42, wherein $t_{OE} \leq 0.875\ t_{EE}$, such as $\leq 0.75\ t_{EE}$, $\leq 0.625\ t_{EE}$, or $\leq 0.5\ t_{EE}$.

Item 44. The synthetic starter tile, assembly, or method of item 43, wherein $t_{OE} \geq 0.125\ t_{EE}$, such as $\geq 0.25\ t_{EE}$, or $\geq 0.5\ t_{EE}$.

Item 45. The synthetic starter tile, assembly, or method according to any one of items 1, 2, 3, or 4, wherein the body comprises a thickness, t, and t varies along a width of the body.

Item 46. The synthetic starter tile, assembly, or method of item 45, wherein t increases from the ridge to the first overlap edge and from the ridge to the second overlap edge.

Item 47. The synthetic starter tile, assembly, or method of item 46, wherein the body comprises a lateral edge thickness, $t_{LE}$, measured at the first lateral edge, the second lateral edge, or both lateral edges, and a ridge thickness, $t_R$, measured at the ridge and $t_R < t_{LE}$.

Item 48. The synthetic starter tile, assembly, or method of item 47, wherein $t_R \leq 0.875\ t_{LE}$, such as $\leq 0.75\ t_{LE}$, $\leq 0.625\ t_{LE}$, or $\leq 0.5\ t_{LE}$.

Item 49. The synthetic starter tile, assembly, or method of item 48, wherein $t_R \geq 0.125\ t_{LE}$, such as $\geq 0.25\ t_{LE}$, or $\geq 0.5\ t_{LE}$.

Item 50. The synthetic starter tile, assembly, or method according to any one of items 1, 2, 3, or 4, wherein the body of the synthetic starter tile comprises a polymeric material.

Item 51. The synthetic starter tile, assembly, or method of item 50, wherein the body of the synthetic starter tile comprises a co-extruded polymeric material.

Item 52. The synthetic starter tile, assembly, or method of item 51, wherein the body of the synthetic starter tile comprises a core material and a skin material at least partially overlying the core material.

Item 53. The synthetic starter tile, assembly, or method of item 52, wherein the skin material overlies the exposed portion.

Item 54. The synthetic starter tile, assembly, or method of item 53, wherein the core material comprises a filled polymeric material.

Item 55. The synthetic starter tile, assembly, or method of item 54, wherein the filled polymeric material comprises a thermoplastic polymeric material and a filler.

Item 56. The synthetic starter tile, assembly, or method of item 55, wherein the thermoplastic polymeric material is selected from a group including polyvinylchloride (PVC), polyethylene (PE), polypropylene (PP), polybutene (PB-1) polymethylpentene (PMP), polyacrylates (PAC), polyethyleneterephthalate (PET), polybutyleneterephthalate (PBT), polyethylenenaphthalate (PEN), ethylene-propylene-diene monomer copolymers (EPDM), a copolymer thereof, a binary blend thereof, and a ternary blend thereof.

Item 57. The synthetic starter tile, assembly, or method of item 55, wherein the filler comprises a mineral filler, an organic filler, a nanofiller, a powdered filter, an ultra-fine powdered filler, a reinforcing filler, a fiber filler, a recycled polymer filler, or any combination thereof.

Item 58. The synthetic starter tile, assembly, or method of item 55, wherein the filled polymeric material comprises an amount of filler ≥5% wt, such as ≥10%, ≥15%, ≥20%, ≥25%, ≥30%, ≥35%, or ≥40%.

Item 59. The synthetic starter tile, assembly, or method of item 58, wherein the amount of filler ≤90% wt, such as ≤85%, ≤80%, ≤75%, or ≤70%.

Item 60. The synthetic starter tile, assembly, or method of item 52, wherein the skin material comprises a thermoplastic polymeric material.

Item 61. The synthetic starter tile, assembly, or method of item 60, wherein the thermoplastic polymeric material comprises a polyolefin, a polyacrylate, or a combination thereof.

Item 62. The synthetic starter tile, assembly, or method of item 61, wherein the polyolefin comprises polyethylene (PE), polypropylene (PP), polymethylpentene (PMP), polybutene (PB-1), or a combination thereof.

Item 63. The synthetic starter tile, assembly, or method of item 60, wherein the skin material further comprises an additive.

Item 64. The synthetic starter tile, assembly, or method of item 63, wherein the additive comprises a UV-light stabilizer, a thermal stabilizer, a pigment, a compatibilizer, a processing aid, a flame retardant, a foaming agent, or a combination thereof.

With the configuration described herein, the synthetic starter tile for an angled roof interface provides a starter tile that can be used, for example, on a hip interface or a valley interface. The starter tile includes an exposed portion having a textured surface finish along an exposed edge that approximates the appearance of a chipped slate tile. Further, the synthetic starter tile includes a solid perimeter edge portion along the bottom of the exposed edge that can effectively seal the underneath of the starter tile and prevent rain from wicking or blowing under the starter tile. Moreover, the exposed edge of the synthetic starter tile includes two angle portions that each form acute compound angles with respect to a longitudinal axis. After installation, the angled portions of the exposed edge can closely approximate the perimeter shape of the underlying roof structure on which the synthetic starter tile is disposed. As such, the synthetic starter tile for an angled roof interface can properly protect the underlying roof structure and properly direct rainwater from the roof into a gutter system. Moreover, while the synthetic starter tile is shown with a cross-section have a downward facing V-shape, it can be understood that the synthetic starter tile can be formed with an upward facing V-shape to fit into a valley interface instead of onto a hip interface. In such a case, the angle portions of the exposed edge can be angled to approximate the shape of the perimeter of the roof at the valley, e.g., in a direction that is generally opposite to the angled portions described herein.

A skilled artisan can recognize that there may be others applications that can utilize a synthetic starter tile for an angled roof interface having one or more of the characteristics described herein.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

In addition, in the foregoing Detailed Description, various features can be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter can be directed to less than all features of any of the disclosed embodiments. Thus, the following claims are incorporated into the Detailed Description, with each claim standing on its own as defining separately claimed subject matter.

What is claimed is:

1. A synthetic starter tile for an angled roof interface, comprising:

a non-planar body defining a longitudinal axis, the body comprising:

an overlap edge perpendicular to the longitudinal axis;

an exposed edge opposite the overlap edge, wherein the exposed edge includes a first angled exposed edge and a second angled exposed edge opposite the first angled exposed edge;

an overlap portion extending from the overlap edge;

an exposed portion comprising a first lateral exposed edge and a second lateral exposed edge opposite the first lateral exposed edge, wherein the first lateral exposed edge extends from the overlap portion to the first angled exposed edge, and wherein the second lateral exposed edge extends from the overlap portion to the second angled exposed edge;

a ridge extending between the overlap edge and the exposed edge along the longitudinal axis;

a first side extending from the ridge;

a second side extending from the ridge, wherein each side includes a lower surface;

a plurality of ribs extending from each lower surface in a generally downward direction, the ribs extending along a length of each side parallel to the longitudinal axis of the non-planar body;

a first lateral edge extending from the overlap edge to the first lateral exposed edge; and a second lateral edge extending from the overlap edge to the second lateral exposed edge and opposite to the first lateral edge;

wherein the exposed edge forms at least one acute compound angle, $A_{CA}$, with respect to the longitudinal axis as viewed from a top view, wherein the non-planar body comprises a generally V-shaped cross-section perpendicular to the longitudinal axis, wherein the first lateral exposed edge, the first angled exposed edge, the second lateral exposed edge, and the second angled exposed edge comprise a surface finish that is different from a remainder of the exposed portion and the overlap portion, and wherein the synthetic starter tile is configured to fit over an angled roof interface, such that the overlap edge is above the exposed edge and the first angled exposed edge extends along a first edge of a roof and the second angled exposed edge extends along a second edge of the roof, and wherein the first edge of the roof and second edge of the roof converge and define a corner of the roof.

2. The synthetic starter tile according to claim 1, wherein the overlap portion includes a length, $L_{OP}$, and the exposed portion includes a length, $L_{EP}$, and $L_{OP} \geq L_{EP}$.

3. The synthetic starter tile of claim 1, wherein the first angled exposed edge establishes a first compound acute angle, $A_{CA1}$, with respect to the longitudinal axis.

4. The synthetic starter tile of claim 1, wherein a thickness at the ridge is uniform along a length of the body.

5. The synthetic starter tile of claim 1, wherein a thickness along the first lateral edge and the second lateral edge is uniform along a length of the body.

6. The synthetic starter tile of claim 1, wherein each of the plurality of ribs is tapered.

7. The synthetic starter tile of claim 1, wherein each of the plurality of ribs comprises a height measured from the lower surface and the height varies along a length of each of the plurality of ribs.

8. The synthetic starter tile of claim 1, wherein the body comprises a solid perimeter edge portion extending at least partially along the exposed edge and each of the plurality of ribs terminates at the solid perimeter edge portion.

9. An assembly for covering an angled roof interface, comprising: a synthetic starter tile comprising:

a non-planar body defining a longitudinal axis, wherein the body comprises:

an overlap edge perpendicular to the longitudinal axis;

an exposed edge opposite the overlap edge, wherein the exposed edge includes a first angled exposed edge and a second angled exposed edge opposite the first angled exposed edge;

an overlap portion extending from the overlap edge;

an exposed portion comprising a first lateral exposed edge and a second lateral exposed edge opposite the first lateral exposed edge, wherein the first lateral exposed edge extends from the overlap portion to the first angled exposed edge, and wherein the second lateral exposed edge extends from the overlap portion to the second angled exposed edge;

a ridge extending between the overlap edge and the exposed edge along the longitudinal axis;

a first side extending from the overlap edge to the exposed edge;

a second side extending from the ridge, wherein each side includes a lower surface;

a plurality of ribs extending from each lower surface in a generally downward direction, the ribs extending along a length of each side parallel to the longitudinal axis of the non-planar body;

a first lateral edge extending from the overlap edge to the first lateral exposed edge; and a second lateral edge extending from the overlap edge to the second lateral exposed edge and opposite to the first lateral edge;

wherein the exposed edge forms at least one acute compound angle, $A_{CA}$, with respect to the longitudinal axis as viewed from a top view;

wherein the non-planar body comprises a generally V-shaped cross-section perpendicular to the longitudinal axis;

wherein the first lateral exposed edge, the first angled exposed edge, the second lateral exposed edge, and the second angled exposed edge comprise a surface finish that is different from a remainder of the exposed portion and the overlap portion; and wherein the synthetic starter tile is configured to fit over an angled roof interface, such that the overlap edge is above the exposed edge and the first angled exposed edge extends along a first edge of a roof and the second angled exposed edge extends along a second edge of the roof, wherein the first edge of the roof and second edge of the roof define a corner of the roof, and wherein the angled roof interface comprises a hip interface.

10. A synthetic starter tile for an angled roof interface, comprising: a non-planar body defining a longitudinal axis, the body comprising:

an overlap edge perpendicular to the longitudinal axis;

an exposed edge opposite the overlap edge, wherein the exposed edge includes a first angled exposed edge and a second angled exposed edge opposite the first angled exposed edge;

an overlap portion extending from the overlap edge;

an exposed portion comprising a first lateral exposed edge and a second lateral exposed edge opposite the first lateral exposed edge, wherein the first lateral exposed edge extends from the overlap portion to the first angled exposed edge, and wherein the second lateral exposed edge extends from the overlap portion to the second angled exposed edge;

a ridge extending between the overlap edge and the exposed edge along the longitudinal axis;

a first lateral edge extending from the overlap edge to the first lateral exposed edge; and a second lateral edge extending from the overlap edge to the second lateral exposed edge and opposite to the first lateral edge, wherein the exposed edge forms at least one acute compound angle, $A_{CA}$, with respect to the longitudinal axis as viewed from a top view;

wherein the non-planar body comprises a generally V-shaped cross-section perpendicular to the longitudinal axis;

wherein the first lateral exposed edge, the first angled exposed edge, the second lateral exposed edge, and the second angled exposed edge comprise a surface finish that is different from a remainder of the exposed portion and the overlap portion, and wherein the synthetic starter tile is configured to fit over an angled roof interface, such that the overlap edge is above the exposed edge and the first angled exposed edge extends along a first edge of a roof and the second angled exposed edge extends along a second edge of the roof, and wherein the first edge and of the roof second edge of the roof define a corner of the roof.

11. The synthetic starter tile of claim 10, wherein the body of the synthetic starter tile comprises a core material and a skin material at least partially overlying the core material.

12. The synthetic starter tile of claim 10, wherein the first angled exposed edge extends from a vertex to the first lateral exposed edge, and wherein the first lateral exposed edge is parallel with the longitudinal axis of the body.

13. The synthetic starter tile of claim 10, wherein $A_{CA}$ is at least 25°.

* * * * *